United States Patent [19]

Karikomi et al.

[11] Patent Number: 4,783,664

[45] Date of Patent: Nov. 8, 1988

[54] SHAPED OFFSET-FED DUAL REFLECTOR ANTENNA

[75] Inventors: Masahiro Karikomi; Kenichi Kagoshima, both of Kanagawa, Japan

[73] Assignee: Nippon Telegraph & Telephone Public Corporation, Tokyo, Japan

[21] Appl. No.: 704,994

[22] Filed: Feb. 25, 1985

[30] Foreign Application Priority Data

Feb. 24, 1984 [JP] Japan ..... 59-32569

[51] Int. Cl.[4] ..... H01Q 19/14

[52] U.S. Cl. ..... 343/781 P; 343/781 CA

[58] Field of Search ..... 343/781 P, 781 CA

[56] References Cited

U.S. PATENT DOCUMENTS

| | | | |
|---|---|---|---|
| 4,343,004 | 8/1982 | Ohm | 343/914 |
| 4,425,566 | 1/1984 | Dragone | 343/781 P |
| 4,464,666 | 8/1984 | Watanabe et al. | 343/781 P |
| 4,503,435 | 3/1985 | Dragone | 343/781 P |
| 4,603,334 | 7/1986 | Yoshihiko et al. | 343/914 |

OTHER PUBLICATIONS

"A Shaped Offset-Fed Dual Reflector Antenna", in IEEE Transactions and Propagation, vol. AP-27, No. 2, Mar. 1979, pp. 165-169.

*Primary Examiner*—William L. Sikes
*Assistant Examiner*—Robert E. Wise
*Attorney, Agent, or Firm*—Armstrong, Nikaido, Marmelstein & Kubovcik

[57] ABSTRACT

A shaped offset-fed dual reflector antenna having a main reflector, a sub-reflector and a primary radiator which do not block the wave-path of said main reflector is improved by using an inclined primary radiator from a boresight axis of the antenna, and the shaped non-quadratic surface in said main reflector and/or said sub-reflector, to provide the desired aperture field distribution, improved cross-polarization characteristics, and improved side-lobe characteristics. The incline angle of the primary radiator is in the range between 10 degrees and 40 degrees. When a gregorian antenna is used, and the aperture field distribution is Tailor's −40 dB distribution, said incline angle is preferably 16 degrees.

6 Claims, 5 Drawing Sheets

SHAPED OFFSET-FED DUAL REFLECTOR ANTENNA

BACKGROUND OF THE INVENTION

The present invention is concerned with an offset-fed dual-reflector antenna whose main reflector and subreflector are shaped in a non-quadratic surface.

An offset-fed dual-reflector antenna has the feature that its primary radiator and sub-reflector do not cover the aperture of its main reflector, therefore, it gives no unnecessary electromagnetic wave scattering and has an excellent wide angle radiation directivity. By reason of the above fact, it has been in practical use for the communications field and in radar applications.

A conventional Cassegrain antenna of the axial symmetry type which does not offset its sub-reflector has the advantage of obtaining an ideal directivity by means of modifying the electric field distribution at the aperture to a desired one with shaped non-quadratic surfaces of reflectors. On the other hand, an offset-fed dual-reflector antenna has no design freedom to choose a desired electric field distribution at the aperture and this is considered a great drawback to an offset-fed dual reflector antenna. This is due to the following reasons.

When the reflector system of an offset-fed dual-reflector antenna is determined by numerical calculation in general, the following three conditions must be satisfied.

(1) The optical path length from a primary radiator's phase center to an aperture plane is constant for every optical path.

(2) The reflection law (incidence angle of input beam is equal to that of output beam) is satisfied at a sub-reflector.

(3) The reflection law is satisfied at a main reflector.

And, in addition to the above three conditions, the following conditions are necessary for obtaining a desired electric field distribution in the radial direction of an aperture.

(4) An energy distribution condition in radial direction (field distribution on an aperture plane).

Further, for an excellent cross polarization characteristic, the following condition is requested.

(5) The electric field distribution at an aperture in the circumferential direction is axis symmetrical.

A solution satisfying the above five conditions simultaneously is, however, impossible because no solution exists and this is the main reason for said drawbacks.

For example, a certain kind of offset-fed dual-reflector antenna (Japanese Patent application. No. 34652/76 "Antenna of an offset aperture type") has a reflector system satisfying the conditions (1), (2), and (3), and the electric field distribution at an aperture is of axial symmetry because of introducing the condition (5) to suppress the generation of cross polarization components. As a result, the electric field distribution in the radial direction is solely determined because the reflector system is determined completely by the four conditions and there is no room for applying the condition. 4), and a desired field distribution on an aperture plane can not be implemented. Therefore, the directivity of the antenna of this kind cannot be optimized to the surrounding radio circuitry, and the said drawbacks of an offset antenna still remain unsolved in this design method.

Another conventional approximation method has been proposed to provide a desired electric field distribution at least in the vertical plane of a reflector (Japanese utility model application No. 19853/83).

In this method, in the first place, only the vertical central cross section curves of an offset-fed dual-reflector antenna are obtained under said conditions (1), (2), (3), and (4). Then, assuming that the surface of a sub-reflector and a main reflector is comprised of a group of ellipses whose long axis exists on the plane obtained by connecting two points of the corresponding cross section curve. Next, the rest of coordinates other than those of the cross section curve is determined applying the conditions (1) and (2) only. Further, an approximation for the condition (5) is obtained by setting the angle between the primary radiator and the sub-reflector properly.

Accordingly, in this method, a desired electric field distribution is established only in the portion of the vertical central cross section curve and its vicinity, and in other portions of a reflector surface the condition (4) is not satisfied.

Generally, an antenna for use in a microwave relay circuit is expected to have an excellent wide angle radiation directivity in the horizontal plane. As the electric field distribution in the horizontal direction is directly related to the directivity, this design method which does not give a desired electric field distribution on an aperture in the horizontal direction is not suitable for antennas of that purpose.

Considering the antenna design methods stated above, a new design method has been proposed where the central axis of a primary radiator is set parallel to the antenna's main radiation direction (boresight axis), and the reflector surface coordinates are calculated under the said conditions (1), (2), (4), and (5). ( Lee, Parad, Chu, "A Shaped Offset-Fed Dual-Reflector Antenna.", IEEE trans. on AP, AP-27, 2, pp. 165/171, March 1979.)

In this method, however, as the condition (3) is completely ignored and the condition (2) is not considered enough, therefore, an electromagnetic wave reflected by a main reflector and propagates toward the main radiation direction has a variety in the direction of its components. And, as this directional error of each point on an aperture is different in magnitude and direction from one another, the total electromagnetic wave does not converge correctly. In a case where the size of the antenna's aperture is not so large compared with the wave length of an electromagnetic wave, the influence of this effect on the co-polarization characteristic can be neglected. But it brings a serious deterioration of the cross polarization characteristic because of the antenna's design based on the condition (4). And, when the aperture's size is longer than 100 times the wave length, the influence of this effect on the co-polarization characteristic cannot be ignored any longer.

SUMMARY OF THE INVENTION

It is an object, therefore, of the present invention to overcome the disadvantages and limitations of a prior dual reflector antenna by providing a new and improved dual reflector antenna.

It is also an object of the present invention which satisfies said conditions (1), (2), (4) and (5).

It is also an object of the present invention which provides a low sidelobe characteristics, and excellent cross polarization characteristics.

The above and other objects of the present invention are attained by a shaped offset-fed dual reflector antenna having a main reflector, a sub-reflector, and a primary radiator, said sub-reflector and said primary radiator not blocking wavepath of said main reflector, surface of said main reflector and said sub-reflector being determined so that an optical path length between phase center of the primary radiator and an aperture plane is constant, the law of reflection at the sub-reflector is satisfied, and field distribution on an aperture plane of the antenna is axis-symmetry, said primary radiator being positioned so that it is slanted from a parallel line to a boresight axis of the antenna by an angle which gives minimum directional error of the antenna from a boresight axis, when desired field distribution on said aperture plane is provided.

BRIEF DESCRIPTION OF THE DRAWINGS

The foregoing and other objects, features, and attendant advantages of the present invention will be appreciated as the same become better understood by means of the following description and accompanying drawings wherein.

DETAILED DESCRIPTION OF THE EMBODIMENTS

Figure 1:
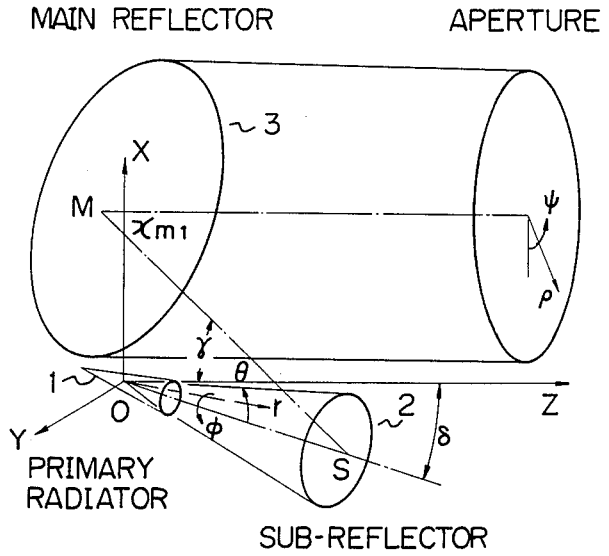
FIG. 1 is a simplified structure of an antenna of the invention for explaining the principle of the present invention.

FIG. 1 shows a brief structure for explanation of the principle of an antenna according to the present invention, where numeral 1 is a primary radiator, 2 is a sub-reflector, and 3 is a main reflector.

The primary radiator 1 has a phase center at the origin 0 (0,0,0) of a rectangular coordinate system X-Y-Z, and the primary radiator 1 has a central axis on X-Z plane where it makes an angle $\delta$ with Z axis, which coincides with boresight axis of the antenna. The primary radiator 1 which has the power directivity in the $\theta$ direction is given by $W_p(\theta)$, while that in the $\phi$ direction is of axial symmetry. Such a directivity can be realized by means of a corrugated horn or the like.

The reflector surface coordinates of the sub-reflector 2 are represented by a spherical coordinate system (r, $\theta$,$\phi$) whose origin is the said origin 0, while the reflector surface coordinates of the main reflector 3 are represented by a cylindrical coordinate system (z ,$\rho$,$\psi$) whose origin is chosen as $X_{m1}$($X_{m1}$, 0, 0). The radiation direction (boresight axis) of the antenna is in the Z axis direction. A desired power distribution at the aperture is denoted by $W_a(\rho)$. That is, the power varies as specified by $W_a(\rho)$ from the aperture's central axis to its radial direction, while in the $\psi$ direction the power distribution is of axial symmetry.

As stated earlier, in order to obtain the antenna's reflector system shown in FIG. 1 by numerical calculation, first of all, the following three conditions are necessary.

(1) The optical path length from a phase center of a primary radiator to an aperture is constant.

(2) The reflection law holds at the sub-reflector 2.

(3) The reflection law holds at the main reflector 3. The reflection law says that an incidence angle of an input beam is equal to that of an output beam.

In addition, the said conditions (4) and (5) are expressed as follows, respectively.

$$\frac{\int_0^{\theta} W_p(\theta)\sin\theta d\theta}{\int_0^{\theta_0} W_p(\theta)\sin\theta d\theta} = \frac{\int_0^{P} W_a(\rho)\rho d\rho}{\int_0^{P_c} W_a(\rho)\rho d\rho} \quad (1)$$

$$(5)\ \phi = \psi \quad (2)$$

where $\theta$ is the angle between the primary radiator 1's central axis and any point on the edge of the sub-reflector 2, and $\rho_o$ is the radius of the aperture.

As stated earlier, it is impossible to get an analytical solution which satisfies the said five conditions simultaneously. The invention provides the following method which makes it possible to get a solution where the said five conditions are satisfied in a practical sense.

In the first place, by solving the said four conditions (1), (2), (4), and (5) simultaneously, the reflector surface coordinates of a main reflector and a sub-reflector are calculated, where the central axis of the primary radiator is assumed to make a constant angle $\delta$ with Z axis at the origin. This calculation is conventional, and is implemented and explained in the article (Lee, Parad, Chu, "A shaped Offset-fed Dual Reflector Antenna", IEEE Trans. on AP, AP-27, 2, pp. 165–171, March 1979). In this state of the reflector system, as the said conditions (2) and (3) are not taken into consideration, an electromagnetic wave radiated from the reflector system does not propagate to Z axis direction but has some directional error.

That error is compensated by the slant angle of a primary radiator. Accordingly, the slanted primary radiator is the important feature of the present invention.

Also, it should be appreciated that the use of a non-quadratic surface for a main reflector and/or a sub-reflector is the important feature of the present invention.

The path traced by an electromagnetic wave which is radiated from the primary radiator, reflected at the subreflector ruled by the reflection law, and then reflected at the main reflector ruled by the reflection law is calculated by means of geometrical optics. The directional error in this case is the angle between the actual direction of path after the reflection at the main reflector and the Z axis.

Figure 2:
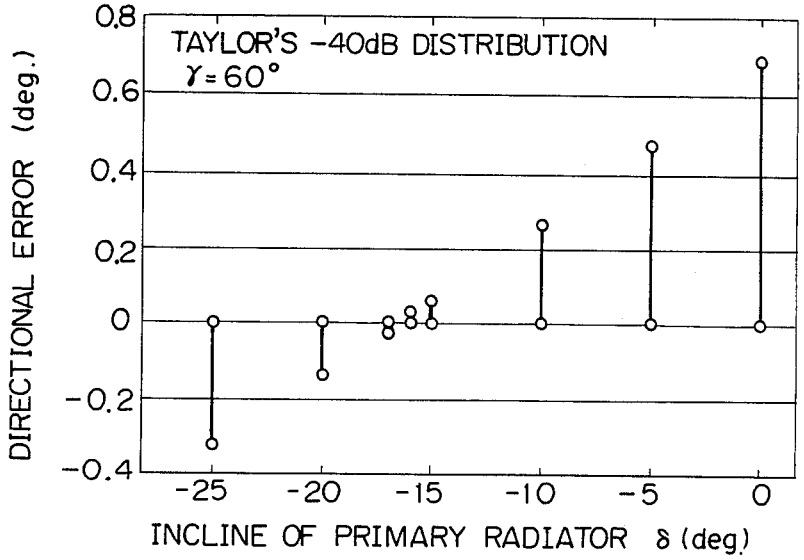
FIG. 2 is a FIGURE for explanation of the effect of incline of the primary radiator's central axis, FIG. 3A

When the slanting angle of the primary radiator is taken as a parameter, and the path for each reflector surface coordinates is calculated one by one, the directional error for each slant angle of a primary radiator changes in absolute value. This is shown in FIG. 2, where x axis, and y axis are scaled in slanting angle ($\delta$) and magnitude of directional error, respectively. The magnitude of directional error depends on a point in the aperture. In general, the nearer is a point to the aperture's center, the smaller is its directional error value, and so the range of directional error for each particular slanting angle ($\delta$) is indicated by a vertical short line in FIG. 2.

In FIG. 2, the power directivity of a primary radiator is approximated by cosine to the power n, and $$W_p(\theta)=\cos^{99.63}(\theta/15) \quad (3)$$

is assumed so that −15 dB is provided when $\theta=15°$.

And the power distribution at aperture is also assumed as follows.

$$W_a(\rho)=\frac{2}{\pi^2}\left[1+1.5996J_0\left(3.832\frac{\rho}{\rho_0}\right)-0.0915J_0\left(7.016\frac{\rho}{\rho_0}\right)+0.0252J_0\left(10.17\frac{\rho}{\rho_0}\right)+0.0013J_0\left(13.32\frac{\rho}{\rho_0}\right)\right] \quad (4)$$

The above expression is a distribution of the low side lobe type known as Tailor distribution (Tailor's −40 dB disbribution).

As seen from FIG. 2, there is an optimum value of slant angle (δ). In this case, directional error becomes nearly zero at (δ)=−16.53°. This optimum value of (δ) depends on $W_p$, $W_a$, and offset angle (γ). If $W_p$ is given the same as that of the equation (3), FIGS. 3A and 3B are obtained for each offset angle (γ) between the path reflected by the sub-reflector and the Z axis.

Figure 3A:
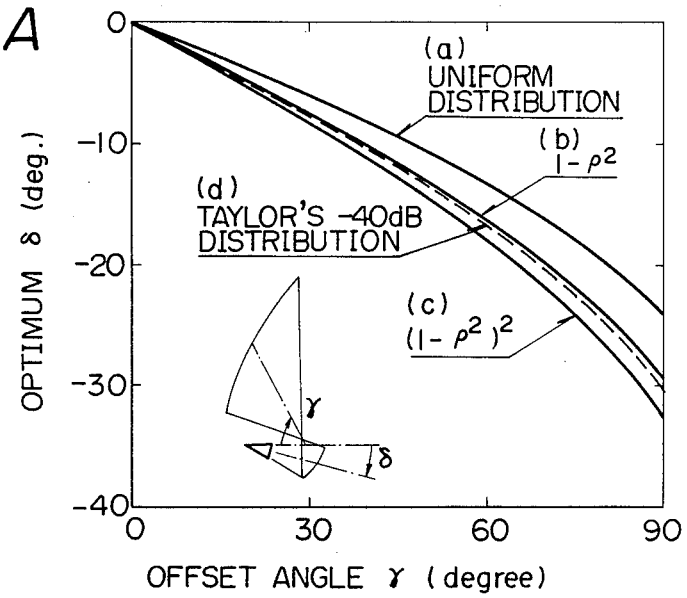
FIG. 3B shows curves for selecting an optimum incline angle of a primary radiator in the present invention.
Figure 3B:
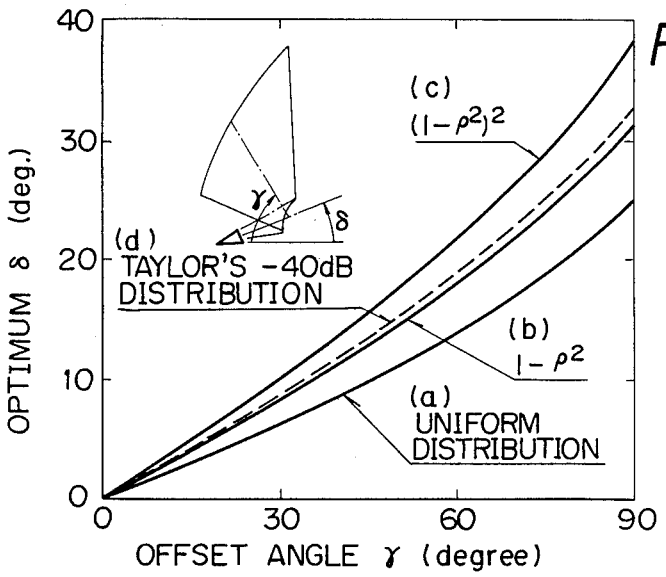

In FIGS. 3A and 3B, x axis, y axis are scaled in offset angle (γ) and optimum slant angle, respectively, while aperture distribution type is taken as a parameter, where an offset angle (γ) is defined as the angle made by the line obtained by connecting the center of main reflector and that of the sub-reflector, and YZ plane. In FIGS. 3A and 3B, the curve (a) shows the case of "uniform distribution" where the electric intensity is uniform over the aperture, i.e., it is a distribution of the so-called high efficiency type. The curve (b) shows the case of $(1-(\rho)^2)$ distribution, the curve (c) shows the case of $(1-(\rho)^2)^2$ distribution, and the curve (d) shows the case of Tailor's −40 dB distribution. The "$(1-(\rho)^2)^2$", and "Tailor's −40 dB distribution" are both of the low side lobe type.

FIG. 3A shows the case where an antenna is a gregorian antenna which has a sub-reflector with concaved surface, and FIG. 3B shows the case where an antenna is a cassegrain antenna which has a sub-reflector with a convex surface.

It should be noted in FIG. 3A that the optimum slant angle (δ) is 16.53° (absolute value) for Tailor's −40 dB distribution, for the offset angle (γ)=60°. Also, in FIG. 3A, the preferable slant angle is 12° (absolute value) for uniform distribution, when the offset angle is 60°.

In case of a cassegrain antenna, as shown in FIG. 3B, the preferable slant angle for Tailor's −40 dB distribution is 18° when the offset angle is 60°, and the preferable slant angle is 14° for uniform distribution when the offset angle is 60°.

As is clear in FIGS. 3A and 3B, the optimum slant angle is negative when a sub-reflector is concaved, and is positive when a sub-reflector is convexed.

Of course, the present idea is applicable to a wide range of distribution types other than shown in FIGS. 3A and 3B.

As explained above, according to the present invention, the slant angle of a primary radiator is first set to the optimum value as shown in FIGS. 3A and 3B, and the reflector surface coordinates are calculated in the method explained earlier, so that an electromagnetic wave reflected at the entire surface of the main reflector propagates in the direction of Z axis with negligible small directional error. Then, the said condition (3) (the reflection law at main reflector) and the condition (4) are satisfied practically.

Figure 4:
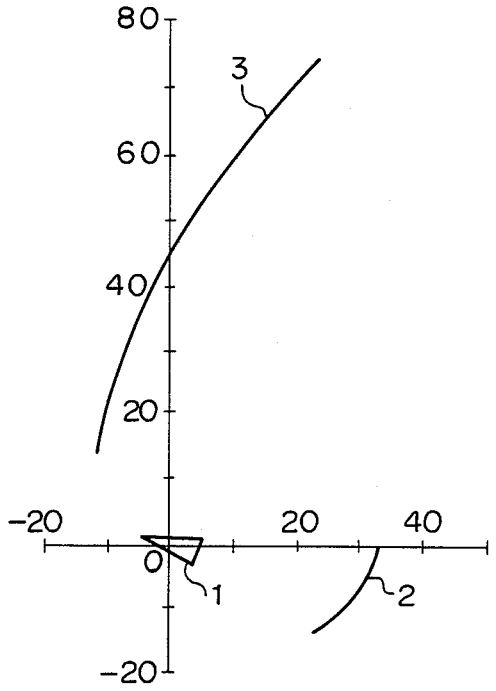
FIG. 4 is a cross section of an embodiment of the present invention.

FIG. 4 shows a cross section of an embodiment of the invention, where 1, 2, 3 indicate the cross sections of a primary radiator, a sub-reflector, and a main reflector, respectively. The scales of x axis, and y axis are normalized by wave length respectively and $W_p$, $W_a$ are equal to those in the equations (3), (4), respectively. Further, (γ)=60°, (δ)=−16.53° are assumed.

Figure 5:
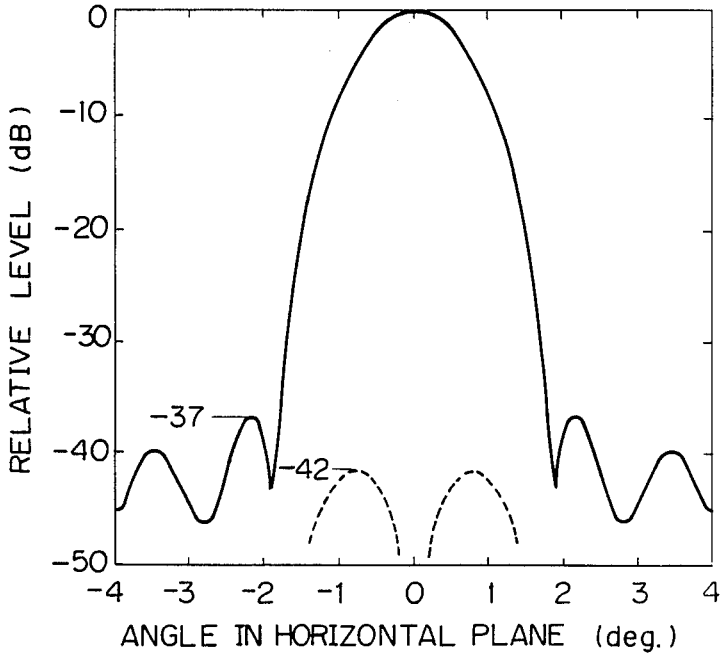
FIG. 5 is a FIGURE showing a theoretical radiation characteristic of the embodiment shown in FIG. 4.

FIG. 5 shows a theoretical radiation characteristics of the embodiment shown in FIG. 4. It is the directivity in horizontal plane by vertical polarization transmission, where the directivity of vertical polarization is shown in solid line and that of horizontal polarization or cross polarization is shown by dotted line. The first side lobe level (in solid line) and the maximum value of cross polarization lobe (in dotted line) are given by −37 dB and −42 dB, respectively, that are low enough for practical purposes. This proves the excellent characteristics of an offset-fed dual-reflector antenna according to the present invention.

Figure 6:
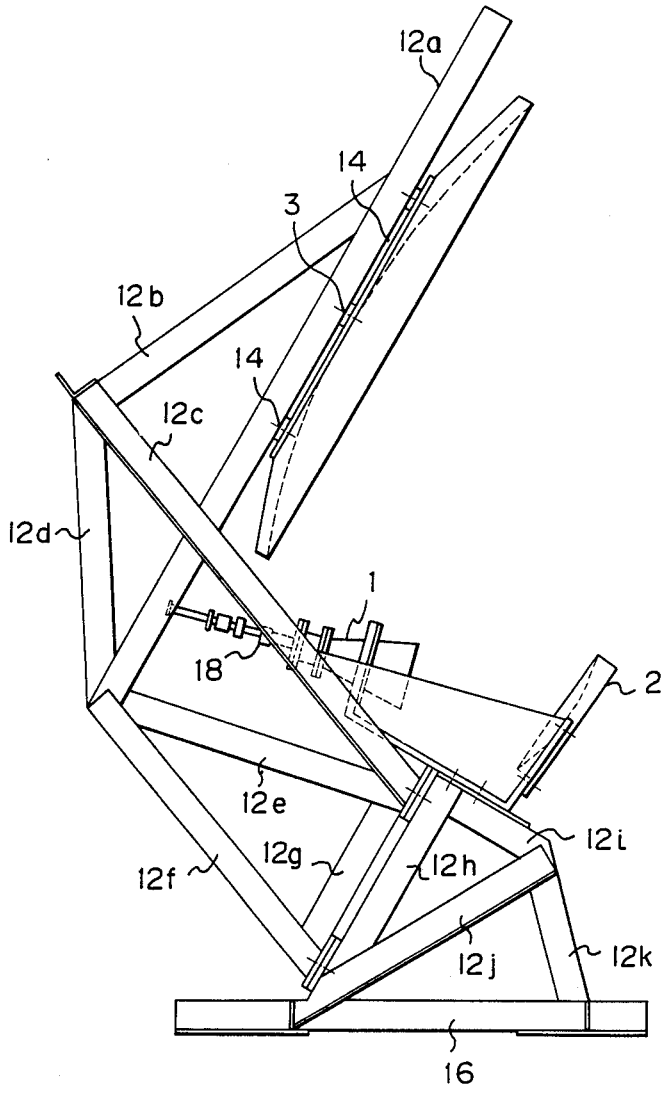
FIG. 6 is the structure of the embodiment of the present antenna.

FIG. 6 shows the experimental structure of a cassegrain antenna according to the present invention. In the FIGURE, the numeral 1 is a primary radiator, 2 is a sub-reflector, 3 is a main reflector, 12*a* through 12*k* are frames, 14 is a pin for fixing a main reflector to a frame, 16 is a mount frame, and 18 is a waveguide for feeding a primary radiator.

It should be appreciated of course that the present invention is applicable both a gregorian type antenna, and, a cassegrain type antenna.

As explained above, in designing an offset-fed dual-reflector antenna, if the primary radiator's central axis is slanted to the antenna's radiation direction by a constant angle, and the reflector surface coordinates of a main reflector and a sub-reflector are obtained so that the aperture's electric field distribution is specified by a particular function in the radial direction from the aperture's center, keeping axial symmetry in the circumferential direction, an electromagnetic wave reflected at the main reflector propagates in the boresight axis direction with small directional error. Therefore, a desired aperture distribution can be realized with small deterioration of the aperture efficiency and cross polarization characteristic.

In addition, if the angle initially slanted is set to an optimum value, the said directional error becomes nearly zero. That is, the aperture's electric field distribution can be a desired one in the radial direction, while it is of axial symmetry in the circumferential direction with all the reflector system's design conditions satisfied.

That is, the invention realizes an offset-fed dual-reflector antenna with an ideal co-polarization directivity and an excellent cross polarization characteristics.

From the foregoing it will now be apparent that a new and improved offset dual reflectors antenna has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A shaped offset-fed dual reflector antenna, comprising:

a main reflector;

a sub-reflector;

a primary radiator;

wherein said sub-reflector and said primary radiator, positioned not to block a wavepath from said main reflector, are determined such that the following conditions are satisfied:

(a) the surface of said main reflector and said sub-reflector are determined so that an optical path length between the phase center of the primary radiator and any pointed on an aperture plane is constant, (b) the law of reflection at the sub-reflector is satisfied, (c) the field distribution on an aperture plane of the antenna has axis-symmetry, and (d) the field distribution has a desired value at any point in the radial direction;

wherein a profile of surface of said sub-reflector and said main reflector is calculated for each slant angle of said primary radiator, where the slant angle is the angle between a line parallel to a boresight axis of the antenna and the axis of said primary radiator, a directional error of the antenna from a boresight axis of a transmission ray from the primary radiator through said sub-reflector and said main reflector is calculated for each slant angle, and said primary radiator is positioned so that it is slanted according to the slant angle which gives a minimum value of said directional error;

wherein the absolute value of the slant angle is in the range between 10° and 40°; and wherein said sub-reflector has a non-quadratic reflector surface.

2. A shaped offset-fed dual reflector antenna according to claim 1, wherein an angle error of slant angle of said primary radiator from the slant angle which gives the minimum value of said directional error is less than 5 degrees.

3. A shaped off-set dual reflector antenna according to claim 1, wherein said slant angle of said primary radiator is approximately 16°, said antenna is a gregorian antenna which has a concave surface of said sub-reflector, with an offset angle 6020 , to provide Tailor's −40 dB distribution on an aperture plane.

4. A shaped offset-fed dual reflector antenna according to claim 1, wherein said slant angle of said primary radiator is approximately 12°, said antenna is a gregorian antenna which has a concave surface in the sub-reflector, with an offset angle 60°; to provide uniform distribution on an aperture plane.

5. A shaped offset-fed dual reflector antenna according to claim 1, wherein said slant angle of said primary radiator is approximately 14°, and said antenna is a cassegrain antenna wherein the subreflector is convex, with an offset angle 60°, to provide uniform distribution on an aperture plane.

6. A shaped offset-fed dual reflector antenna according to claim 1, wherein said slant angle of said primary radiator is approximately 18°, said antenna is a gregorian antenna which has a concave surface of said sub-reflector, with an offset angle 60°, to provide Taylor's −40 dB distribution on aperture plane.

* * * * *